United States Patent [19]

Rader et al.

[11] Patent Number: 4,629,182

[45] Date of Patent: Dec. 16, 1986

[54] INFLATABLE TOY TUNNEL

[76] Inventors: Sandra B. Rader; Steven J. Rader, both of 10336 Woodley Ave., Granada Hills, Calif. 91344

[21] Appl. No.: 747,701

[22] Filed: Jun. 24, 1985

[51] Int. Cl.[4] ..... A63B 71/02; A63B 71/16

[52] U.S. Cl. ..... 272/113

[58] Field of Search ..... 272/113, 1 R, 1 B, 3; 446/85, 220, 221, 901; 52/2 E

[56] References Cited

U.S. PATENT DOCUMENTS

| | | | |
|---|---|---|---|
| 903,632 | 11/1908 | Tilyou | 272/1 R |
| 2,830,606 | 4/1958 | Daugherty | 52/2 |
| 3,110,552 | 11/1963 | Voelker | 52/2 X |
| 4,335,545 | 6/1982 | Couch | 52/2 |

FOREIGN PATENT DOCUMENTS

| | | | |
|---|---|---|---|
| 0168447 | 6/1951 | Australia | 272/1 R |
| 0041581 | 6/1980 | European Pat. Off. | 446/901 |
| 2153253 | 5/1973 | Fed. Rep. of Germany | 52/2 |
| 1300206 | 6/1962 | France | 446/901 |
| 0623469 | 6/1981 | Switzerland | 52/2 |

OTHER PUBLICATIONS

*Pneumatic Structures* by Thomas Herzog, copyright 1976, pp. 70–71.

*Primary Examiner*—Robert A. Hafer
*Assistant Examiner*—Kathleen D'Arrigo
*Attorney, Agent, or Firm*—Albert O. Cota

[57] ABSTRACT

A tunnel formed of a thermoplastic film with an outside and inside surface with compressed air in between. The tunnel consists of end sections (20) connected by longitudinal sections (22) to support sections (24), each having openings therebetween, allowing communication for introducing the compressed air. A second embodiment is similar, except it utilizes helical shaped sections (34) formed in a round configuration. A polygon shaped center intersection (40) connects the tunnels together with hook and loop tape (28) bonded to each mating surface forming a matrix when used in conjunction with a plurality of tunnels and intersections. The hollow interior of the devices allow children at play to enter and crawl through while within the protective enclosure afforded by the invention.

4 Claims, 12 Drawing Figures

INFLATABLE TOY TUNNEL

TECHNICAL FIELD

The invention pertains to the general field of inflatable structures, and more particularly to a thermoplastic material structure that inflates into a tubular passageway tunnel primarily used as a toy by young children.

BACKGROUND ART

Previously, many types of toys have been devised to help develop childrens body spatial relationships. As an example, rigid tubes positioned together, end to end with a wood base, to prevent rolling, are presently in use. Other such tunnels, using helical spring steel hoops covered with a cloth or plastic material are commonly in use and are known in the industry by their registered tradenames, FUN-L-TUN-L, or a similar device is identified as the CRAWL TUNNEL.

Prior art has also used inflatable structures in various forms as toys or articles for sport. A search of the prior art did not disclose any patents that read directly on the claims of the instant invention, however, the following U.S. patents were considered related.

| Patent Number | Inventor | Issue Date |
|---|---|---|
| 3,994,102 | Johnson et al | Nov. 30, 1976 |
| 3,934,291 | Hagen | Jan. 27, 1976 |
| 3,779,201 | Spahn | Dec. 18, 1973 |
| 3,664,290 | Finn | May 23, 1972 |

Johnson et al teaches a plurality of inflatable elements with loops on each end. The loops are connected together to make joints and form structures. The joint means are inherent in the inflated structure of the elements.

Hagen discloses a unitary hollow paddle wheel of a size to receive a person in an upright position. The device is composed of two circular pneumatic tubes connected in spaced relationship by transverse members that also support a tread.

Spahn utilizes a hollow dirigible-balloon shaped device having spaced inflated double walls of pliable plastic. A pair of spaced plastic dividers are located within the interior of the structure providing reinforcement and the inner rims function as hand rails.

Finally, Finn employs a spherical shaped device formed of an annular series of buoyant segments, each having an externally outwardly extending paddle. An annular buoyant member is attached at each open end of the part-spherical body to provide stability.

Although some of the above inventions utilize a tubular shaped inflated body, the combination of the instant invention as a tunnel is lacking.

DISCLOSURE OF THE INVENTION

In child growth, the use of devices that help development of body control in motion, such as creeping and crawling, are becoming more prevalant. Presently, rigid structural tubes, or pipes, are in use both indoors and out. Flexible collapsing tunnels are especially popular for indoor use, however, these devices, as well as the outdoor equipment with a hard bottom surface, have a tendency to scuff the childrens legs and clothing and are uncomfortable when in use. It is, therefore, a primary object of the invention to have a resilient surface completely surrounding a tunnel allowing continual use without discomfort to the user or excessive clothing wear. This is particularly important when the tunnel is used by handicapped children who do not have complete mobility and may injure themselves on conventional apparatus. The instant invention utilizes a flexible thermoplastic material formed with an inner and outer sleeve with compressed air inside to accomplish this utility.

As the material and accompanying structure is completely resilient, an important object is realized eliminating sharp edges or hard framework within the tunnel. This object allows the children at play complete license to crawl upon or within and even dive into the open end with no fear of injury from the device itself. As the bottom of the invention is resilient, therapeutic application in the development of equilibrium may be realized when crawling through the tunnel.

Another object of the invention provides a multitude of combined shapes and matrixes when joined together with similar sections and intersections. A number of sections may be attached in tandum with one end of the assembly connected to a multiple opening intersection. Also, others may be attached projecting at various angles therefrom. This flexible arrangement allows the children to use their imagination and creativity in organizing the desired shape or form with the sections at hand. Further, the invention may be in a basic cylindrical form or any shape depicting an animal or object, such as a dragon, snake, centipede, etc., to enhance the interest of the user.

Still another object allows construction with cost effective material, such as polyvinyl chloride, or any other substance having characteristics suitable for inflating, including thermoplastic impregnated cloth, and the like.

Yet another object allows the device to be easily inflated by the use of a valve, well known in the art, that may incorporate a pump of hair dryer attached thereto. This valve also allows oral inflation by a person, however, this method takes considerable time and effort, but may be used conveniently if other mechanical means are unavailable.

These and other objects and advantages of the present invention will become apparent from the subsequent detailed description of the preferred embodiment and the appended claims taken in conjunction with the accompanying drawings.

BEST MODE FOR CARRYING OUT THE INVENTION

Figure 1:
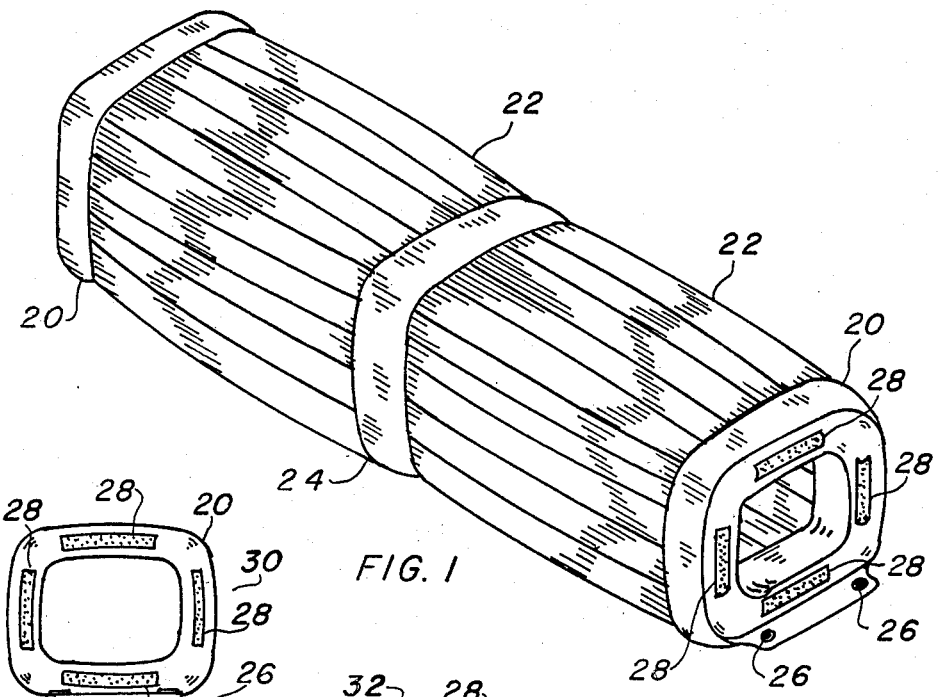
FIG. 1 is a partial isometric view of the preferred embodiment.

The best mode for carrying out the invention is presented in terms of a preferred and second embodiment. These embodiments are both related to tunnels that may be attached together along with intersections connected in a maze-like manner. The preferred embodiment is illustrated in FIGS. 1–3, 6, and 12, and is comprised of a quadrangular shaped pair of ends 20 formed of an inflatable material with an air space between the inner and outer surface. This material is used for the construction of the entire structure and may consist of a thermoplastic film material, such as polyethylene, polyvinyl chloride, polystyrene, or polypropylene.

A plurality of longitudinal sections 22, each having a number of air pockets, are attached to the end pieces 20. The connection is made in such a manner as to have a direct air passageway between the elements allowing communication of compressed air therebetween.

One or more support sections 24, shaped in the same manner as the ends 20, are similarly connected to the longitudinal sections 22 forming a continuous tunnel. Air passageways are likewise made to interface with the longitudinal sections allowing the entire tunnel to be inflated from a single point. A valve, well known in the art, is installed into the assembly at any convenient location. Inasmuch as the tunnel has an inner and outer wall filled with air in between, the center portion is left open allowing entrance and egress for children at play. An open or closed cell foam pad may be added to the bottom inside surface of the tunnel serving as a further cushion or a wear strip. While this structure is within the scope of the invention, it is not necessarily essential, nor is it required.

A plurality of ground attaching loops 26 are located at the extremes of the tunnel attached to each end. These loops 26 may be either the grommet type of a two piece metallic composition, a separate strip of material the same as the tunnel formed into a loop shape, a hole punched into the parent material and heat sealed around the periphery, or any other convenient method. If the tunnel is used out of doors, such as on a lawn, these loops 26 may be utilized to attach the device to the ground to prevent shifting by the wind or unintentional relocation.

Each end 20 contains connecting means 28 on the exposed outside surface. This structure is in the form of snap fasteners built integrally with the material of the ends 20, or preferably, is comprised of continuous strips of hook and loop tape, known commonly by its registered tradename, VELCRO. This tape is bonded to the ends 20 with adhesive and forms a reusable and removable joining system for a like tunnel for extension thereof or for attachment to other structures.

Figure 2:
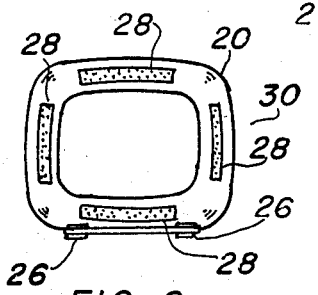
FIG. 2 is an end view of the preferred embodiment in a rectangular configuration.
Figure 3:
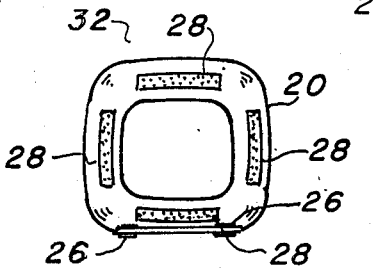
FIG. 3 is an end view of the preferred embodiment in a square configuration.
Figure 6:
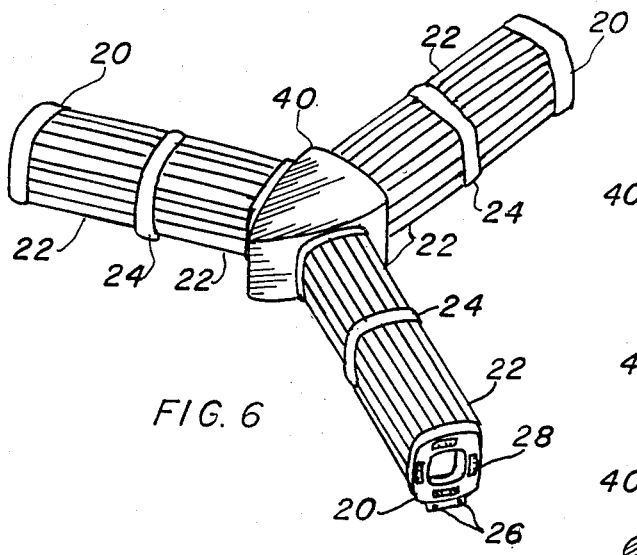
FIG. 6 is a partial isometric view of the preferred embodiment assembled with 3 rectangular sections and a triangular center intersection.

The shape of the tunnel may vary with the quadrangle having each corner at right angles in a rectangular configuration 30, as shown in FIGS. 1 and 2, or a square shape 32, depicted in FIGS. 3 and 6.

Figure 4:
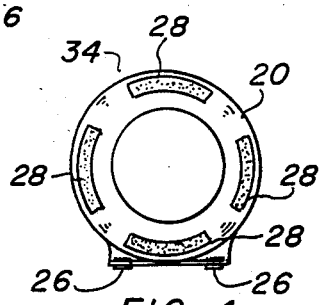
FIG. 4 is a view of the round shaped second embodiment.
Figure 5:
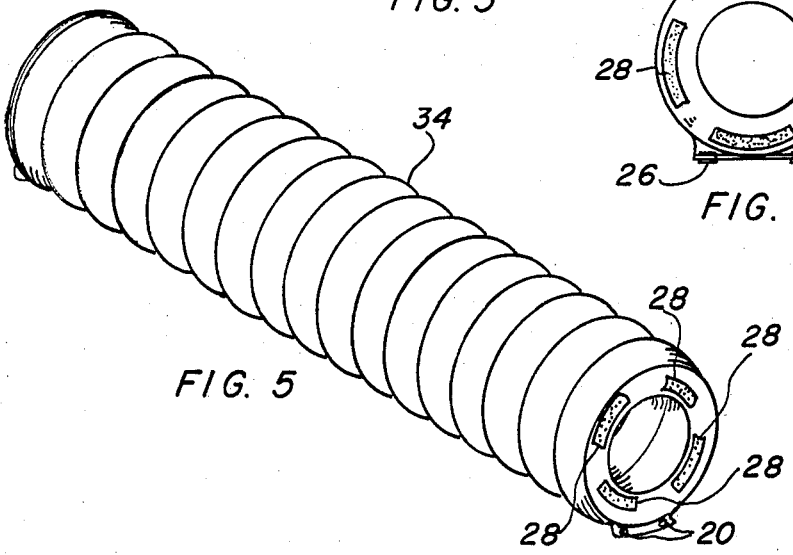
FIG. 5 is a partial isometric view of the second embodiment.
Figure 7:
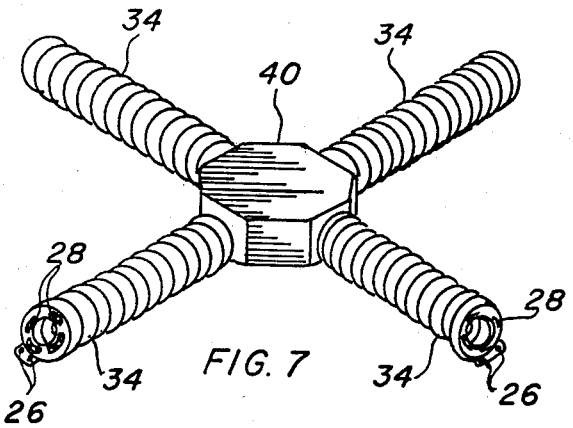
FIG. 7 is a partial isometric view of the second embodiment assembled with 4 round sections and a hexagonal center intersection.

The second embodiment is shown pictorially in FIGS. 4, 5, and 7, and varies only in the physical shape its difference is that it is round. As such, the support section is in a helical form 34 and a secondary support section is lacking. The helical shaped support section 34 may be fabricated in such a manner as to have the air sections in one continuous spiral, or may be segmented, as long as communication between sections is present. Other combinations of shape of the basic round configuration 34, such as flared ends, may be an acceptable alternative without departing from the scope of this invention. Ground attaching loops 26 and connecting means 28 are provided in like manner, as included with the preferred embodiment.

Figure 11:
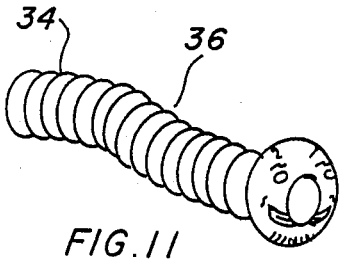
FIG. 11 is an isometric view of an embodiment shaped like a caterpillar.
Figure 12:
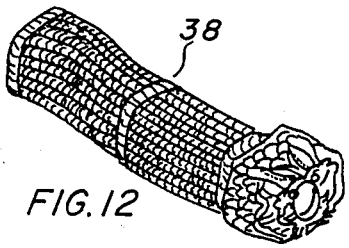
FIG. 12 is an isometric view of an embodiment shaped like a dragon.

Alternate configurations of both the preferred and second embodiment include shapes of one of the ends 20 that may be in a form resembling an animal, insect, figures, or the like. FIG. 11 illustrates such a form as a caterpillar 36 is depicted with the features painted or printed onto the surface, giving an appearance to the tunnel that may be of interest to the children using the invention. FIG. 12 exhibits a dragon-like form 38 with the square tunnel.

Figure 8:
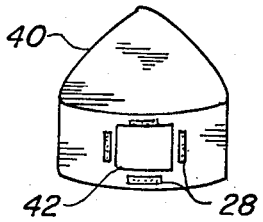
FIG. 8 is a partial isometric view of a triangular intersection.
Figure 9:
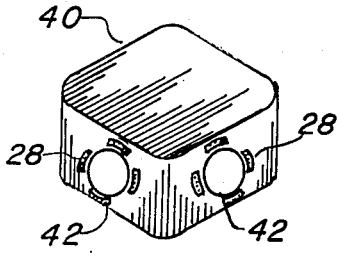
FIG. 9 is a partial isometric view of a square intersection.
Figure 10:
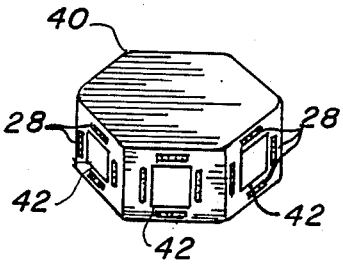
FIG. 10 is a partial isometric view of a hexagonal intersection.

In conjunction with the tunnel, the invention includes a polygon shaped center intersection 40 that has a top, floor, and multiple sides of the same material and construction, as previously introduced. This intersection 40 is in the shape of a triangle, square, quadrangle, as shown in FIGS. 8, 9, and 10, hexagon, etc., however, it must have at least two sides containing openings 42 for access into the interior chamber. These openings 42 are of the same size as the ends 20 of the tunnels and contain connecting means 28. This connection, in the form of hook and hoop take, allows the end 20 of the tunnel to be attached to any given opening 42 yielding to the creation of a tunnel with an intersection 40 in the middle, and one or more passageways projecting in an outward manner. Limitless combinations and matrixes may be formed with a number of tunnels and intersections allowing children to crawl through at play.

While the invention has been described in complete detail and pictorially shown in the accompanying drawings, it is not to be limited to such details, since many changes and modifications may be in the invention without departing from the spirit and the scope thereof. Hence, it is described to cover any and all modifications and forms which may come within the language and scope of the appended claims.

We claim:

1. An inflatable toy tunnel comprising:

(a) a first and second quadrangularly shaped end each having an outside and inside wall with compressed air therebetween forming a collapsible structure;

(b) a plurality of longitudinal sections having an outside and inside wall with compressed air therebetween attached to said first and second end with communication therein;

(c) a plurality of quadrangularly shaped supports having an outside and inside wall with compressed air therebetween communicably abutting said longitudinal sections forming a segmented tunnel with a clear passageway therethrough, allowing entrance and egress for children at play;

(d) a plurality of ground attaching loops at the lower extremes of said tunnel for fastening to the surface upon which the tunnel is resting; and, (e) connecting means on the exposed outside surface of said ends for attachment to a like structure for lengthening and the creation of an assembled matrix, said connecting means comprising continuous strips of hook and loop tape bonded to said ends with adhesive forming a removable and reusable joining system.

2. An inflatable toy tunnel comprising:

(a) a first and second quadrangularly shaped end each having an outside and inside wall with compressed air therebetween forming a collapsible structure;

(b) a plurality of longitudinal sections having an outside and inside wall compressed air therebetween attached to said first and second end with communication therein;

(c) a plurality of quadrangularly shaped supports having an outside and inside wall with compressed air therebetween communicably abutting said longitudinal sections forming a segmented tunnel with a clear passageway therethrough, allowing entrance and egress for children at play;

(d) a plurality of ground attaching loops at the lower extremes of said tunnel for fastening to the surface upon which the tunnel is resting;

(e) connecting means on the exposed outside surface of said ends for attachment to a like structure for lengthening and the creation of an assembled matrix; and, (f) a polygonal shaped center intersection having a top, floor, and a plurality of sides, each side having an opening interfacing with said first end, of said tunnel, and connecting means attached to the outside surface of the sides in such a manner as to graspingly embrace the like elements on said first ends for connecting a plurality of tunnels together to form a maze for children to crawl through at play.

3. An inflatable toy tunnel comprising:

(a) a first and second radial end, each having an inside and outside wall with compressed air therebetween forming a collapsible structure;

(b) a helically shaped support section having an outside and inside wall with compressed air therebetween communicably abutting said first radial end on one terminus and said second radial end on the other, forming a segmented tunnel with a clear passageway therein allowing entrance and egress for children at play;

(c) a plurality of ground attaching loops at the lower extremes of said tunnel for fastening to the surface upon which the tunnel is resting; and, (d) connecting means on the exposed outside surface of said ends for attachment to a like structure for lengthening and the creation of an assembled matrix said connecting means comprising continuous strips of a hook and loop tape bonded to said ends with adhesive, forming a removable and reusable joining method.

4. An inflatable toy tunnel comprising:

(a) a first and second radial end, each having an inside and outside wall with compressed air therebetween forming a collapsible structure;

(b) a helically shaped support section having an outside and inside wall with compressed air therebetween communicably abutting said first radial end on one terminus and said second radial end on the other, forming a segmented tunnel with a clear passageway therein allowing entrance and egress for children at play;

(c) a plurality of ground attaching loops at the lower extremes of said tunnel for fastening to the surface upon which the tunnel is resting;

(d) connecting means on the exposed outside surface of said ends for attachment to a like structure for lengthening and the creating of an assembled matrix; and (e) a polygonal shaped center intersection having a top, floor, and a plurality of sides, each side having an opening interfacing with said first end of said tunnel, and connecting means attached to the outside surface of the sides in such a manner as to graspingly embrace the like elements on said first end for connecting a plurality of tunnels together to form a maze for children to crawl through at play.

* * * * *